US008376322B2

(12) United States Patent
Hoglund

(10) Patent No.: US 8,376,322 B2
(45) Date of Patent: Feb. 19, 2013

(54) STEAM HUMIDIFIER WITH AUTO-CLEANING FEATURE

(75) Inventor: Steven Hoglund, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 577 days.

(21) Appl. No.: 12/636,467

(22) Filed: Dec. 11, 2009

(65) Prior Publication Data

US 2011/0140291 A1 Jun. 16, 2011

(51) Int. Cl.
*B01F 3/04* (2006.01)

(52) U.S. Cl. ..... 261/27; 261/128; 261/129; 261/142; 261/DIG. 4

(58) Field of Classification Search ..... 261/100, 261/142, 107, 128, 141, 129, 137, 27, DIG. 4; 219/273
See application file for complete search history.

(56) References Cited

U.S. PATENT DOCUMENTS

| | | | | |
|---|---|---|---|---|
| 3,660,635 | A | | 5/1972 | Liebert |
| 3,867,485 | A | * | 2/1975 | Yeagle ..... 261/7 |
| 4,054,122 | A | | 10/1977 | Reed |
| 4,287,407 | A | | 9/1981 | Treiber et al. |
| 4,675,505 | A | | 6/1987 | Fischer |
| 4,705,936 | A | | 11/1987 | Fowler |
| 4,841,122 | A | | 6/1989 | Marton |
| 4,869,853 | A | | 9/1989 | Chen |
| 4,952,779 | A | | 8/1990 | Eaton-Williams |
| 5,363,471 | A | | 11/1994 | Jones |
| 5,440,668 | A | | 8/1995 | Jones |
| 5,758,018 | A | | 5/1998 | Fowler, Jr. |
| 6,078,729 | A | | 6/2000 | Kopel |
| 6,148,144 | A | | 11/2000 | Milanese |
| 6,792,963 | B2 | | 9/2004 | Kopel |
| 7,281,498 | B2 | | 10/2007 | Besik |
| 2006/0027267 | A1 | | 2/2006 | Fritze |
| 2008/0131103 | A1 | | 6/2008 | Nordmann |
| 2008/0317447 | A1 | | 12/2008 | Lentz et al. |

OTHER PUBLICATIONS

"Installation Instructions for the Programmable Humidifier Automatic Flushing Timer," Part No. 000-0756-245, 2 pages, prior to Dec. 11, 2009.

* cited by examiner

*Primary Examiner* — Robert A Hopkins
(74) *Attorney, Agent, or Firm* — Seager Tufte & Wickhem LLC.

(57) ABSTRACT

The disclosure relates generally to steam humidifiers with an auto-cleaning feature, and more particularly, to steam humidifiers that include an auto-cleaning feature for automatically cleaning impurities and/or other byproducts from the steam humidifier while still operating the humidifier in a relatively efficient manner. In some illustrative embodiment, this may be accomplished by providing some level of flexibility of when an auto-cleaning routine is initiated and performed. For example, tank flushing may be initiated and performed preferentially during non-heating states of the steam humidifier, which may potentially decrease down time and increase attainable output capacity and efficiency of the steam humidifier.

24 Claims, 6 Drawing Sheets

STEAM HUMIDIFIER WITH AUTO-CLEANING FEATURE

TECHNICAL FIELD

The disclosure relates generally to humidifiers, and more particularly, to steam humidifiers with an auto-cleaning feature.

BACKGROUND

In dry or colder climates, it is often desirable to add moisture to the air that is inside of an enclosed space such as a building in order to maintain suitable humidity levels. There are a variety of products on the market today that employ various techniques to provide humidification including, for example, steam injection, water atomization, and evaporation. Such humidifiers are often used in conjunction with forced air residential and commercial heating, ventilation, and air conditioning (HVAC) systems.

A steam type humidifier typically heats water to make steam, and then provides the steam into a desired air stream, such as a duct of a forced air HVAC system. Such steam humidifiers are typically connected to a water source of the building, and draws the water from the water source into a water tank. The water in the water tank is then heated to produce steam. In many cases, the water contains certain impurities such as certain minerals, chemicals and/or other impurities. When this water is boiled, some or all of the impurities tend to be left behind, and if not properly removed, can build up and ultimately clog the humidifier.

What would be desirable, therefore, is a steam humidifier that includes an auto-cleaning feature for automatically cleaning the impurities and/or other byproducts from the steam humidifier, while still operating the humidifier in an efficient manner.

SUMMARY

The disclosure relates generally to steam humidifiers with an auto-cleaning feature, and more particularly, to steam humidifiers that include an auto-cleaning feature for automatically cleaning impurities and/or other byproducts from the steam humidifier while still operating the humidifier in a relatively efficient manner. In some illustrative embodiment, this may be accomplished by providing some level of flexibility of when an auto-cleaning routine is initiated and performed. For example, tank flushing may be initiated and performed preferentially during non-heating states of the steam humidifier, which may potentially decrease down time and increase attainable output capacity and efficiency of the steam humidifier.

In an illustrative but non-limiting example, the disclosure provides a method for flushing a steam humidifier having a water reservoir. The steam humidifier may have a heating state for generating steam and a non-heating state. The steam humidifier may be configured to alternate between the heating state and the non-heating state during normal operation to provide a desired level of humidity to an inside space. A humidistat or the like that is positioned in the inside space may control when the steam humidifier is the heating and non-heating states.

The method for flushing the steam humidifier may include executing a flush routine, during which the water reservoir is flushed, and after the flush routine is executed, alternating between the heating state and the non-heating state for a run time period. A defined window of time follows the end of the run time period, and if the steam humidifier enters the non-heating state during the defined window of time, the flush routine may be executed again. Following this, the steps of alternating between heating and non-heating states during the run time period, and executing the flush routine if the steam humidifier enters the non-heating state during a window of time following the run time period are repeated one or more times. In some cases, this method may be extended to include executing the flush routine at the end of the window of time if the steam humidifier has not entered the non-heating state during the defined window of time.

In another illustrative but non-limiting example, the disclosure may provide a steam humidifier having a heating state and a non-heating state. The steam humidifier may include a water-heating reservoir and a controller configured for commanding flushing of the water-heating reservoir. The controller may command flushing of the water-heating reservoir if a minimum time interval has elapsed since a last flushing and if the steam humidifier is in the non-heating state, or if a maximum time interval has elapsed since the last flushing.

The above summary is not intended to describe each and every disclosed illustrative example or every implementation of the disclosure. The Description that follows more particularly exemplifies the various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following detailed description of various illustrative embodiments in connection with the accompanying drawings, in which.

DESCRIPTION

The following description should be read with reference to the drawings, in which like elements in different drawings are numbered in like fashion. The drawings, which are not necessarily to scale, depict selected illustrative embodiments and are not intended to limit the scope of the invention. Although examples of construction, dimensions, and materials are illustrated for the various elements, those skilled in the art will recognize that many of the examples provided have suitable alternatives that may be utilized.

Figure 1:
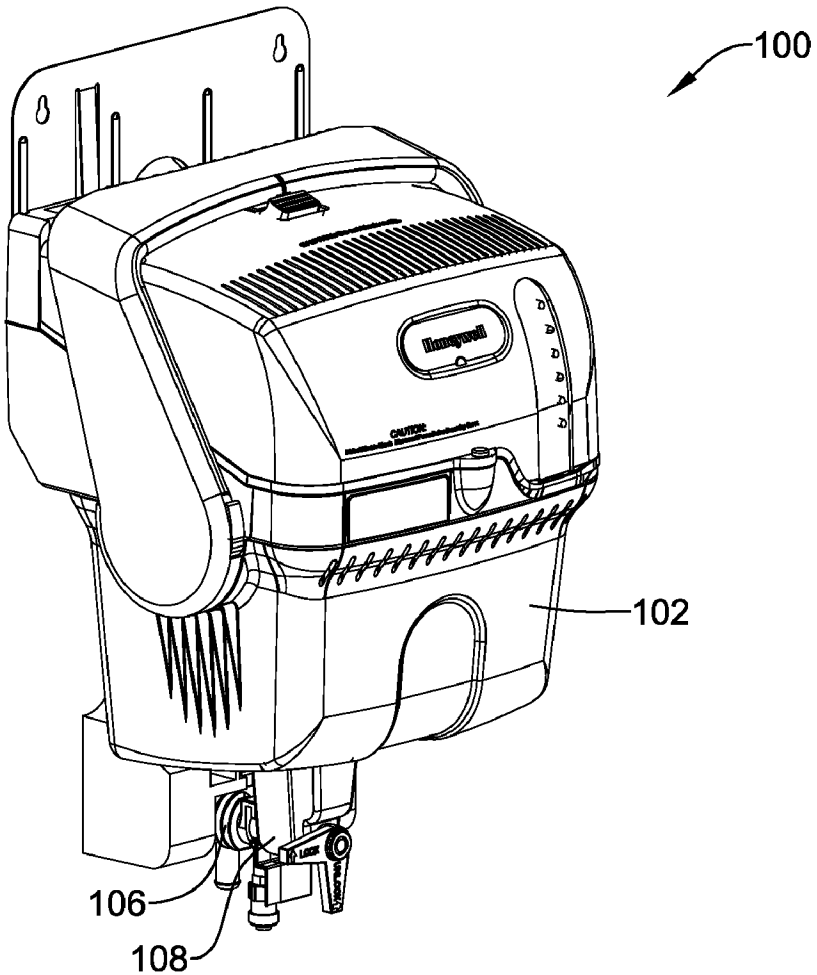
FIG. 1 is a perspective view of an illustrative steam humidifier.

FIG. 1 is a perspective view of an illustrative steam humidifier 100. Steam humidifier 100 includes a water-heating tank or reservoir 102, and a heating element (not shown; disposed in tank 102) in thermal communication with water in the tank 102. When the tank 102 is filled with water to a suitable level, the humidifier 100 may be disposed in a heating state where power, typically electrical power, is provided to the heating element to boil or otherwise heat the water to produce steam, which is typically introduced into an airstream within an HVAC duct to which the humidifier may be attached. The steam humidifier 100 may generally alternate or cycle between heating and non-heating states, depending on the demand for humidity by the system. Entry of water into the tank may be controlled by a water supply valve 106 coupled to a water supply. Drainage from the tank may be controlled by a water drain valve 108 coupled to a water drain.

Over time, heating of water and production of steam will result in a buildup of byproducts such as sediment, minerals, debris, and the like. These byproducts, if allowed to accumulate, may result in one or more undesirable effects, such as reduced heat transfer from the heating element, reduced capacity in the tank 102, clogging of the water drain valve 108, etc. Therefore, it is desirable to remove these byproducts of steam production from the tank 102. Removal of the byproducts may be achieved by, for example, flushing the tank from time to time. Flushing generally may be accomplished, by, for example, draining water from the tank by opening water drain valve 108, and filling the tank by opening water supply valve 106. Any appropriate sequence of controlling valves 106 and 108 may be practiced. For example, draining may be followed by filling, with no overlapping time where both valves 106, 108 are open, or both valves may be open simultaneously such that water entering the tank from the water supply valve may flowingly transport debris out through the open drain valve. Other sequences of valve operations may also be useful.

A controller (not shown) may be included as part of humidifier 100, or may be provided externally and interfaced with the humidifier. The controller may be configured to command flushing of the humidifier when appropriate conditions are met, and/or command steps to be performed in executing a humidifier flush routine, such as opening and closing valves 106, 108, as well as possibly controlling other aspects of humidifier operation.

Figure 2:
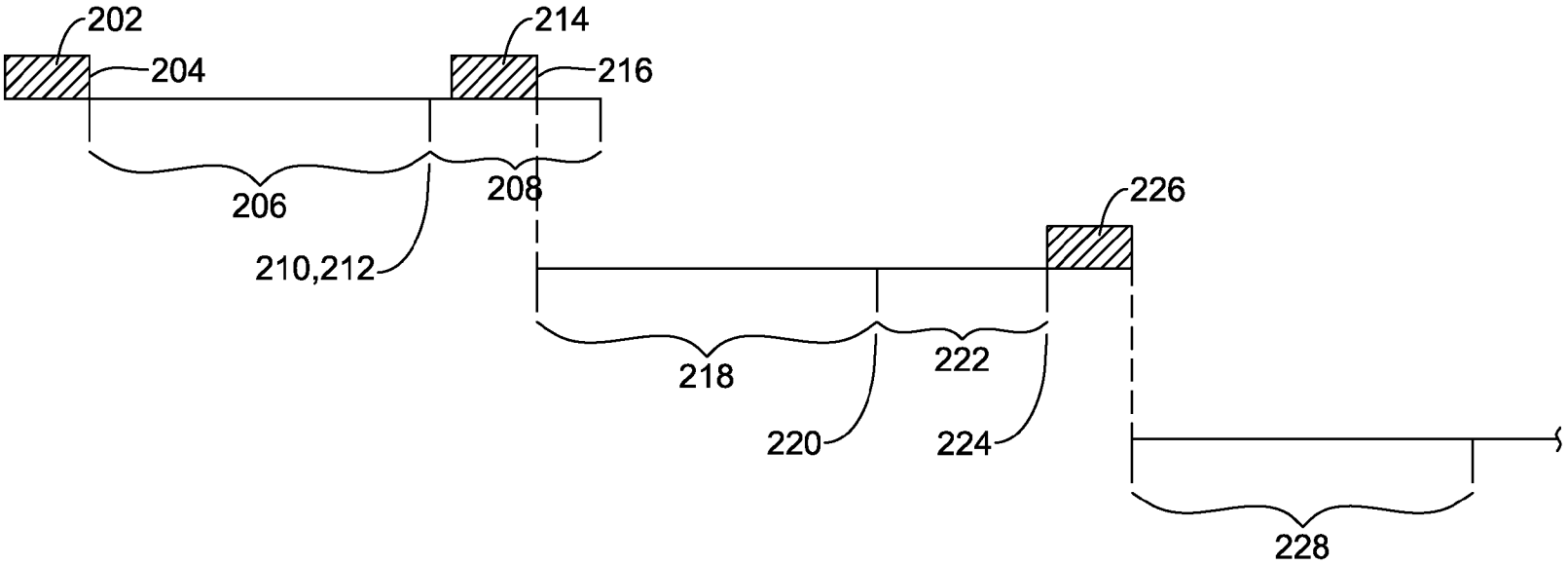
FIG. 2 is a schematic time sequence illustrating aspects of an illustrative method of flushing a steam humidifier.

FIG. 2 is a schematic time sequence illustrating aspects of an illustrative method of flushing a steam humidifier, such as steam humidifier 100 of FIG. 1, or any other suitable steam humidifier. In the time sequence illustrations of FIG. 2, time progresses forward toward the right. The illustrative method starts with execution of a flush routine at 202. At the end 204 of the initial flush routine 202, a run time period 206 commences. During the run time period 206, the humidifier may alternate between a heating state and a non-heating state, often under the control of a humidistat or the like, without interruption from a flush routine. Alternating between heating and non-heating states may depend on, for example, the current demand for humidity in the inside space of the building. In FIG. 2, a defined window of time 208 follows the end 210 of the run time period 206. As shown, the start 212 of the window of time 208 coincides with the end 210 of the run time period 206, but this is not required. After the start 212 of the window of time 208, the steam humidifier may execute a flush routine when appropriate conditions are met, as described further herein.

During the window of time 208, the steam humidifier may execute a flush routine when the steam humidifier enters a non-heating state. An example of this is represented in the time sequence as flush routine 214. Executing a flush routine may include a number of steps, discussed here in connection with steam humidifier 100, though the flush routine described may be executed with any suitable and compatible steam humidifier. Before flushing the water tank 102 of FIG. 1, it may be desirable or necessary to ensure that the water is at a safe or otherwise acceptable temperature. This may, for example, help avoid a scalding injury to anyone who might come into contact with the flushed water, to avoid damage to plumbing not intended for high temperatures, and/or for environmental considerations, etc. In cases where a flush routine has been entered after the humidifier 100 of FIG. 1 enters a non-heating state, such as flush routine 214 of FIG. 2, executing the flush routine may include remaining in the non-heating state during the flush routine. In other cases, when a flush routine is commanded while the humidifier 100 is in a heating state, the flush routine may include reverting the humidifier to the non-heating state, and remaining in the non-heating state during the flush routine. Other steps taken to ensure that the water is at an acceptable temperature may include obtaining a measure of the water temperature, for example, with a temperature sensor (not shown). If the temperature is determined to be below a threshold value ("safe value"), flushing of the reservoir may proceed. If not, the water temperature measurement may be repeated until the water temperature is determined to be safe (e.g., below the threshold value). In some instances, a flush routine may include waiting for a cooling period of time before flushing the reservoir.

Executing a flush routine may take a non-negligible amount of time, particularly in view of temperature safety considerations and/or the water reheat times. During this non-negligible amount of time, the steam humidifier may be generally considered to be off-line and unable to provide humidity to a calling system. Ill-timed execution of such flush routines, for example, those that interrupt heating states during calls for humidity, may significantly degrade a steam humidifier's output capacity and/or performance. By waiting until a non-heating state begins, sometimes during the defined window of time 208, the illustrative method of FIG. 2 may avoid or at least reduce the negative impacts of some or all flush routines.

In certain scenarios, such as during a period of high demand for humidification, a steam humidifier may not enter a non-heating state for an extended period of time, and more particularly, may not enter a non-heating state during the defined window of time 208 following a run time period 206. It is still desirable, nonetheless, to flush the humidifier from time to time to maintain performance of the steam humidifier. An illustration of such a scenario is presented in FIG. 2, as the time sequence progresses past flush routine 214. At the end 216 of flush routine 214, another run time period 218 commences. Following the end 220 of run time period 218, another defined window of time 222 begins. During window of time 222, the steam humidifier does not enter a non-heating state, and accordingly, a flush routine is not invoked during the window of time 222. Upon reaching the end 224 of the window of time 222 without having executed a flush routine, the illustrative method of FIG. 2 executes flush routine 226 regardless of the disposition of the humidifier in a heating or non-heating state. Upon completion of flush routine 226, another runtime period 228 begins. The method generally may execute a flush routine once per window of time, either during a non-heating state during the window of time, or upon reaching the end of the window of time. In many instances, the method does not execute a flush routine more than once during a single window of time following a run time period.

Figure 3:
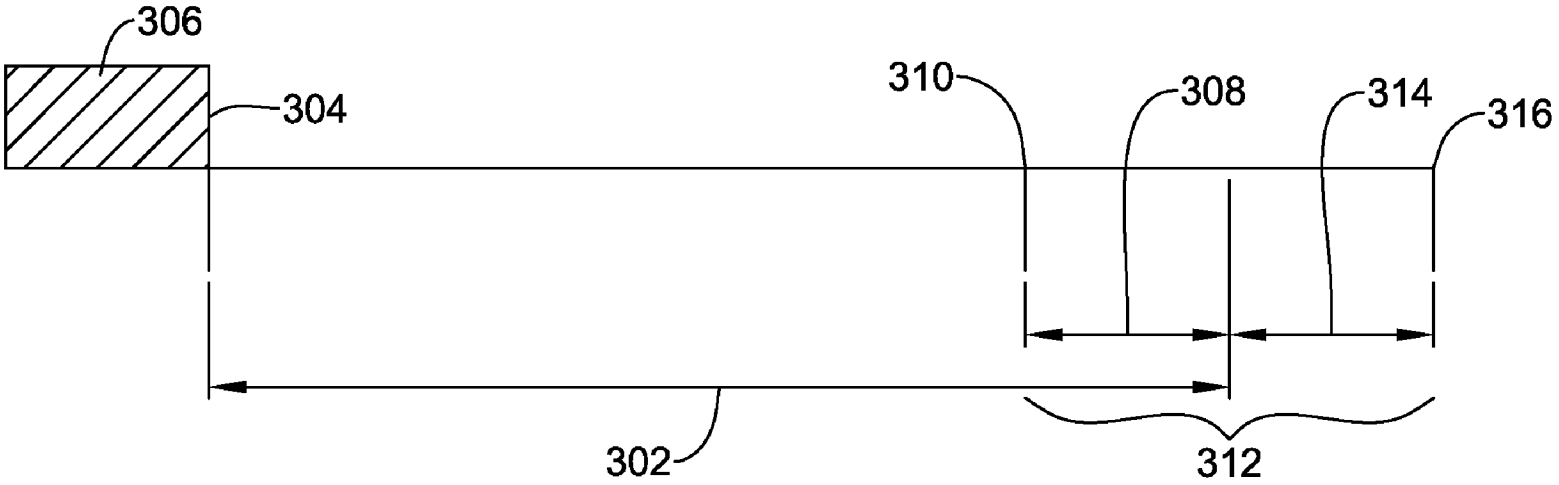
FIG. 3 schematically illustrates one way of defining a window of time.

The disposition of a window of time following a run time period may be defined in any appropriate way. For example, in some illustrative embodiments, a window of time commences immediately upon the end of a run time period, and extends for a defined window of time duration. In other illustrative embodiments, a window of time may be described in terms of other quantitative parameters. FIG. 3, for example, schematically illustrates one way of defining a window of time. A nominal flush time delay 302 is timed relative to the end 304 of a flush routine 306. The nominal flush time delay 302 may represent a desired, but not required, time span between flush routines. A first predetermined time span 308 is the amount of time by which the start or beginning 310 of window of time 312 precedes the completion of the nominal flush time delay 302. A second predetermined time span 314 is the amount of time by which the end 316 of the window of time 312 follows the completion of the nominal flush time delay 302. The window of time 312 shown in FIG. 3 may thus be defined in a method such as the method illustrated in FIG. 2, or any other suitable method. Further, the values of the parameters that describe such a window of time, as well as the magnitude of the run time period, may be configurable by an end user, by an installer, at the time of manufacture or design, or in any suitable way as desired.

Figure 4:
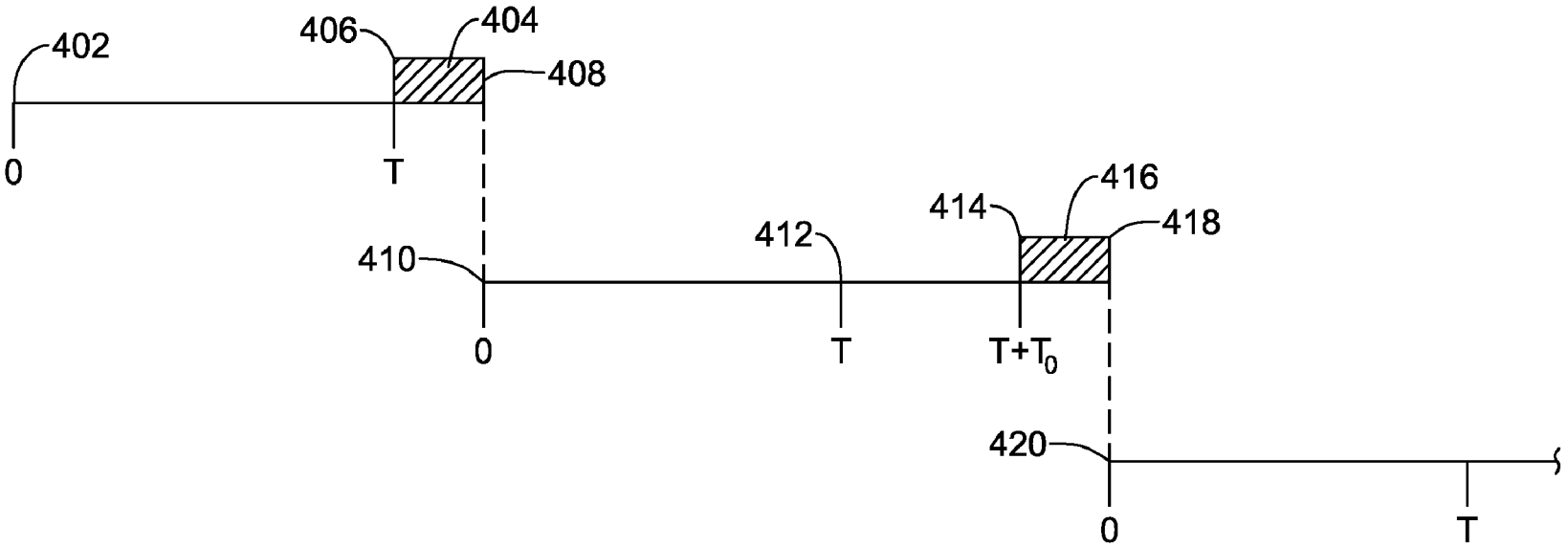
FIG. 4 is a schematic time sequence illustrating aspects of another illustrative method of flushing a steam humidifier.

FIG. 4 is a schematic time sequence illustrating aspects of another method of flushing a steam humidifier. The illustrated method starts with resetting a timer at 402, where the timer reports an elapsed time since it was reset. Later, if the elapsed time since reset is greater than an interval T, and if a flush routine has not yet been executed during the elapsed time since reset, and if the steam humidifier is in the non-heating state, a flush routine is executed. In FIG. 4, the flush routine 404 meets these conditions and starts at 406, immediately upon reaching elapsed time T. Executing a flush routine in the illustrative method of FIG. 4 may be performed in any suitable way, including as disclosed in connection with the method illustrated in Figure. Upon reaching the end 408 of the flush routine 404, the timer may be reset, as shown at 410. Time progresses, and elapsed time T is again reached at 412, but during this cycle, the humidifier is not found in the non-heating state, and so the method continues without executing a flushing routine. At 414 in FIG. 4, the elapsed time reaches T plus an overtime tolerance $T_O$. Upon reaching this time ($T+T_O$), without having already executed a flush routine, the illustrative method proceeds to execute a flush routine 416, regardless of the disposition of the humidifier in a heating or non-heating state. Upon completion of the flush routine 416 at 418 in FIG. 4, the timer may again be reset, as shown at 420. In the illustrative method of FIG. 4, the period from T to $T_O$ may correspond to the window of time shown and described with respect to FIG. 2.

Figure 5:
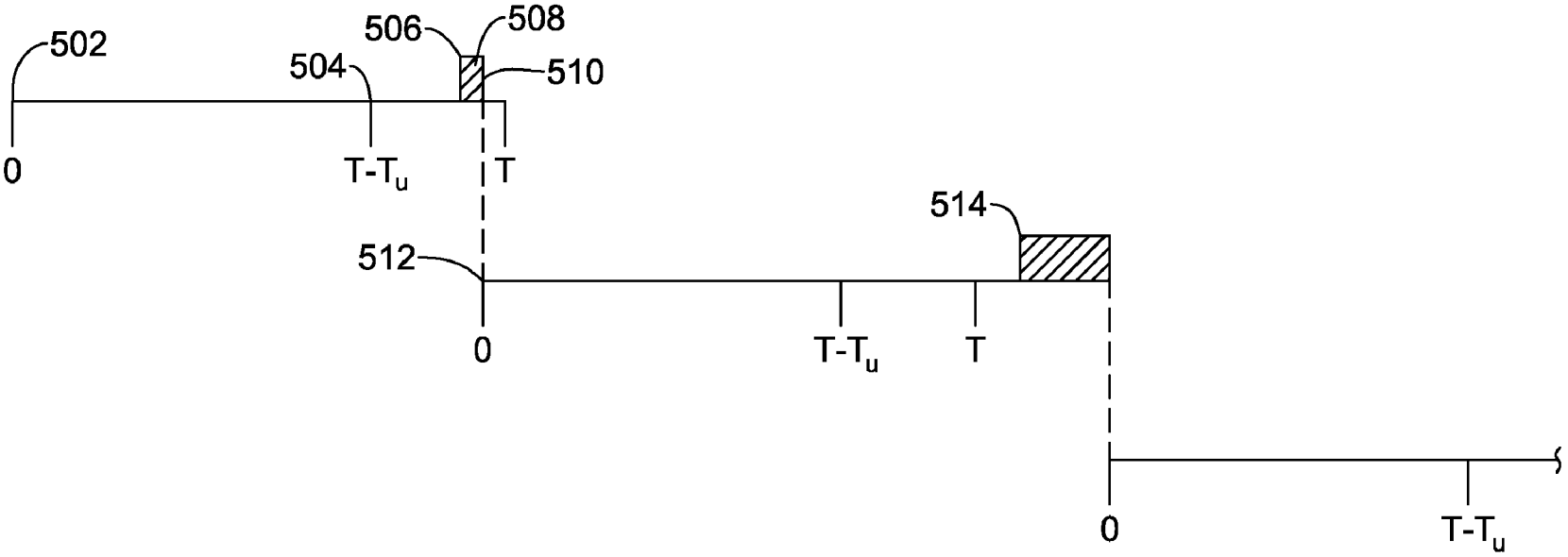
FIG. 5 is a schematic time sequence illustrating aspects of an optional extension to the method of FIG. 4.

FIG. 5 is a schematic time sequence illustrating aspects of an optional extension to the method of flushing a steam humidifier illustrated in FIG. 4. The optional extension provides for flushing the humidifier opportunistically before an elapsed time T after the previous reset has been reached, if the temperature of the water in the reservoir is low enough to allow immediate flushing without requiring waiting for the water to cool to a safe temperature. In this extension, an under time tolerance $T_U$ may be defined, and if the elapsed time since reset is less than the interval T, but greater than $T-T_U$, and if the flush routine has not yet been executed during the elapsed time since reset, and if the steam humidifier is in the non-heating state, and if the water temperature of the water in the reservoir is at or below a threshold value, the reservoir may be flushed. In essence, allowing the possibility of flushing opportunistically is another way to provide maintenance flushing while minimally impacting humidifier output capacity and efficiency. When water is sufficiently cool in the reservoir, the step of cooling prior to flushing, which costs time, may be avoided, with only the penalty of flushing the reservoir a little earlier than nominally planned (when within $T_U$ of reaching time T).

Referring specifically to FIG. 5, a timer is reset at 502. At 504, the timer has not yet reached an elapsed time interval of T, but the time is within $T_U$ of reaching time T. At 506, the time has still not reached T, but temperature of the water in the reservoir has dropped to or below a threshold value and the humidifier is in the non-heating state, so a flushing routine 508 starts. Flushing routine 508 is initiated relatively quickly, as no cooling period is needed, and ends at 510, upon which the timer is reset again, as shown at 512. Moving forward from the reset at 512, conditions for starting a flushing routine are not satisfied again until 514, which occurs after the under time opportunity period between $T-T_U$ and T. That is, at 514, the humidifier is shown entering the non-heating state when the timer is at an elapsed time greater than interval T. It is contemplated that the values of parameters of the method illustrated in FIG. 5, such as T, $T_O$, and $T_U$, may be determined by an end user, by an installer, at the time of manufacture or design, or in any other suitable way as desired.

Figure 6:
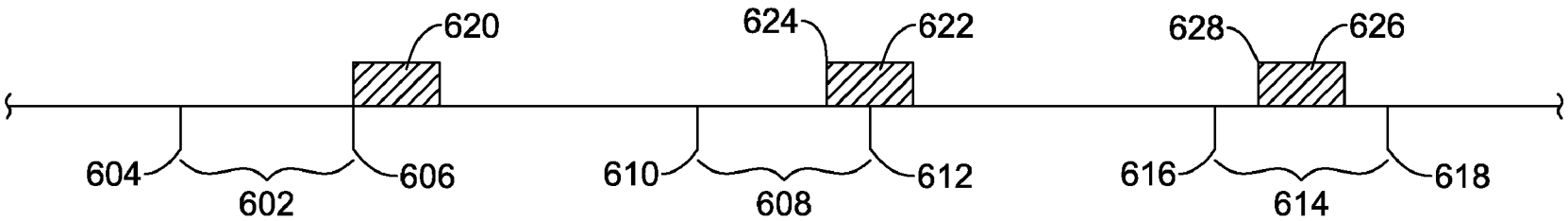
FIG. 6 is a schematic time sequence illustrating aspects of yet another illustrative method of flushing a steam humidifier.

FIG. 6 is a schematic time sequence illustrating aspects of another illustrative method of flushing a steam humidifier. In this illustrative method, one or more flushing windows are determined, with each flushing window having a window start time and a window end time. In FIG. 6, three flushing windows have been determined. A first window 602 has a start 604 and an end 606. A second window 608 has a start 610 and an end 612. A third window 614 has a start 616 and an end 618. First, second, and third are used here merely as labels and do not necessarily designate order relative to a method start time. Any suitable method may be used to determine the one or more flushing windows of the method illustrated in FIG. 6. For example, the windows may be determined by an end user, by an installer, at the time of manufacture or design, by a control algorithm, or in any suitable manner, as desired. In some illustrative embodiments, two or more flushing windows space in time by at least four hours are determined. In some illustrative embodiments, two or more flushing windows may be determined for every day, with the flushing windows at substantially similar times of each day. It may be desirable to place flushing windows at similar times every day, for example, when humidity demand is likely to be lower, or when flushing would be less disruptive to occupants or activities.

The conditions for executing flush routines relative to the windows 602, 608, 614 of FIG. 6 may be similar to the conditions discussed in connection with the illustrative methods discussed herein. As shown in FIG. 6, during the first flushing window 602, the humidifier remains in a heating state and no flush routine is entered until reaching the end 606 of the window 602, upon which flush routine 620 executes regardless of the heating or non-heating state of the humidifier (the humidifier is placed in a non-heating state). After flush routine 620 ends, the humidifier may proceed without consideration of entering another flush routine until the second flushing window 608 commences at 610. In the illustrative diagram of FIG. 6, the humidifier is still be in a heating state at 610, and flush routine 622 does not execute until 624, when the humidifier enters a non-heating state. During the third flushing window 614, flush routine 626 only starts after a non-heating state is entered by the humidifier at 628.

In the illustrative method of FIG. 3, the timing of flushing windows is determined by a determining step, and the timing of a particular flushing window does not necessarily depend directly upon the execution of the immediately preceding flushing routine. In contrast, in the method shown in FIG. 2, a run time period generally commences at the end of an immediately preceding flush routine. Commonly, in that method, a window of time would immediately follow a run time period, and hence a fixed period of time may separate windows of time from immediately preceding flush routines.

In the method of FIG. 6, the time span separating a flushing window from an immediately preceding flush routine may be varied, as desired.

Methods of the present disclosure may be implemented in any suitable way, with any suitable equipment. For example, a steam humidifier like or similar to steam humidifier 100 of FIG. 1 may be provided with a controller or controllers capable of commanding and/or controlling flush routines using any of the methods disclosed herein. In some illustrative embodiments, after-market controllers may be provided that may be retrofitted to work with existing steam humidifiers to practice methods disclosed herein.

In one embodiment, a steam humidifier having a heating state and a non-heating state is provided. The humidifier may include any or all features of steam humidifier of FIG. 1. The humidifier may have a water-heating reservoir and a controller configured for commanding flushing of the water-heating reservoir. The controller may command flushing of the water-heating reservoir if a minimum time interval has elapsed since a last flushing, and if the steam humidifier is in the non-heating state. The controller also may command flushing if a maximum time interval has elapsed since the last flushing. The controller may be configured to initiate a flushing routine for flushing the water heating reservoir. The flush routine may include determining that a water temperature in the water-heating reservoir is below a threshold value, draining the water-heating reservoir after the water temperature in the water-heating reservoir is determined to be below a threshold value, and refilling the water-heating reservoir after the water-heating reservoir is drained. The humidifier may include a temperature sensor for sensing the temperature of the water in the water-heating reservoir and communicating the temperature to the controller. The humidifier may include valves fluidly coupled to a water drain and a water supply, controllable by the controller, so as to drain water from and direct water into the water-heating reservoir.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A method for flushing a steam humidifier having a water reservoir, the steam humidifier having a heating state for heating water in the water reservoir to generate steam, and a non-heating state, wherein the steam humidifier is configured to alternate between the heating state and the non-heating state during normal operation, the method comprising:

(a) executing a flush routine, wherein during the flush routine, the water reservoir is flushed;

(b) after the flush routine is executed, alternating between the heating state, during which the steam humidifier heats the water in the water reservoir to generate steam, and the non-heating state, for a run time period;

(c) if the steam humidifier enters the non-heating state during a window of time following the end of the run time period, executing the flush routine again; and (d) repeating steps (b)-(c) one or more times.

2. The method of claim 1 wherein the executing step (c) executes the flush routine at the end of the window of time if the steam humidifier has not entered the non-heating state during the window of time.

3. The method of claim 1 wherein the executing step (c) executes the flush routine not more than once during the window of time.

4. The method of claim 1 wherein the start of the window of time coincides with the end of the run time period.

5. The method of claim 1, wherein the window of time is defined relative to a nominal flush time delay after execution of the flush routine of step (a), such that the window begins a first predetermined time span before the nominal flush time delay and ends a second predetermined time span after the nominal flush time delay.

6. The method of claim 5, wherein one or more of the nominal flush time delay, the first predetermined time period, and the second predetermined time period are configurable by a user.

7. A method for flushing a steam humidifier having a reservoir, the steam humidifier having a heating state for heating water in the reservoir to generate steam, and a non-heating state, the method comprising:

(a) resetting a timer, the timer reporting an elapsed time since reset;

(b) if the elapsed time since reset is greater than an interval T, and if a flush routine has not yet been executed during the elapsed time since reset, and if the steam humidifier is in the non-heating state, executing the flush routine;

(c) if the elapsed time is greater than the interval T plus an overtime tolerance $T_O$, and if the flush routine has not yet been executed during the elapsed time since reset, executing the flush routine; and (d) if the steam humidifier is in the heating state, heating the water in the reservoir to generate steam.

8. The method of claim 7, further comprising repeating steps (a)-(d) one or more times.

9. The method of claim 7, wherein executing the flush routine comprises:

determining if a water temperature of the water in the reservoir is below a threshold value; and flushing the reservoir after the water temperature of the water in the reservoir is below the threshold value.

10. The method of claim 7, wherein executing the flush routine comprises:

if the steam humidifier is in the heating state at the onset of executing the flush routine, reverting to the non-heating state during the flush routine; and remaining in the non-heating state during the flush routine.

11. The method of claim 7, further comprising the step of:

if the elapsed time since reset is less than the interval T, but greater than $T-T_U$, where $T_U$ is an undertime tolerance $T_U$, and if the flush routine has not yet been executed during the elapsed time since reset, and if the steam humidifier is in the non-heating state, and if a water temperature of water in the reservoir is at or below a threshold value, flushing the reservoir opportunistically.

12. A method for flushing a steam humidifier having a reservoir and having a heating state for heating water in the reservoir to generate steam, and a non-heating state, the method comprising:

if the steam humidifier is in the heating state, heating the water in the reservoir to generate steam;

determining one or more flushing windows, each of the one or more flushing windows having a window start time and a window end time;

executing a flush routine if a current time is within a current flushing window if the steam humidifier has not been flushed already during the current flushing window and if the steam humidifier is in the non-heating state;

executing a flush routine upon reaching a window end time of the current flushing window if the steam humidifier has not been flushed already during the current flushing window; and repeating the executing steps for any subsequent flushing windows.

13. The method of claim 12, wherein executing the flush routine comprises:

determining if a water temperature of the water in the reservoir is below a threshold value; and flushing the reservoir after the water temperature of the water in the reservoir is below the threshold value.

14. The method of claim 13, wherein executing the flush routine comprises:

obtaining a measure of the water temperature;

determining that the water temperature as safe only when the water temperature is below the threshold value; and if the water temperature is not determined to be safe, repeating the measuring and determining steps until the water temperature is determined to be safe.

15. The method of claim 12, wherein executing the flush routine comprises:

waiting for a cooling period of time; and flushing the reservoir after the cooling period of time.

16. The method of claim 12, wherein executing the flush routine comprises:

reverting to the non-heating state if the steam humidifier is in the heating state at the onset of executing the flush routine; and remaining in the non-heating state during the flush routine.

17. The method of claim 12, wherein the determining step determines two or more flushing windows spaced in time, wherein each of the two or more flushing windows are spaced in time by at least four hours.

18. The method of claim 12, wherein the determining step determines two or more flushing windows every day, wherein the two or more flushing windows are at substantially similar times of day each day.

19. A steam humidifier having a heating state and a non-heating state, comprising:

a water-heating reservoir in which water is selectively heated to produce steam; and a controller configured for commanding flushing of the water-heating reservoir;

wherein the controller evaluates whether the following conditions are met:

(a) a minimum time interval has elapsed since a last flushing, and the steam humidifier is in the non-heating state; or (b) a maximum time interval has elapsed since the last flushing;

and if either condition (a) or (b) is met, the controller commands flushing of the water-heating reservoir.

20. The steam humidifier of claim 19, wherein the flushing routine includes:

determining that a water temperature in the water-heating reservoir is below a threshold value;

draining the water-heating reservoir after the water temperature in the water-heating reservoir is determined to be below a threshold value; and refilling the water-heating reservoir after the water-heating reservoir is drained.

21. The steam humidifier of claim 20 further comprising a temperature sensor for sensing the temperature of the water in the water-heating reservoir, the temperature sensor in communication with the controller.

22. The steam humidifier of claim 20 further comprising a valve fluidly coupled to a water supply and controlled by the controller, wherein the valve when activated, directs water into the water-heating reservoir to refill the water-heating reservoir.

23. The steam humidifier of claim 20 further comprising a valve fluidly coupled to a water drain and controlled by the controller, wherein the valve when activated, drains water from the water-heating reservoir.

24. The method of claim 7, wherein the overtime tolerance $T_O$ is non-zero.

* * * * *